United States Patent [19]

Haberstroh et al.

[11] Patent Number: 4,574,557

[45] Date of Patent: Mar. 11, 1986

[54] APPARATUS FOR STORING SHEETS

[75] Inventors: Markus Haberstroh, Landsberg; Paul Schaefer, Neufahrn, both of Fed. Rep. of Germany

[73] Assignee: GAO Gesellschaft fur Automation und Organisation mbH, Fed. Rep. of Germany

[21] Appl. No.: 560,842

[22] Filed: Dec. 13, 1983

[30] Foreign Application Priority Data

Dec. 29, 1982 [DE] Fed. Rep. of Germany ..... 3248523

[51] Int. Cl.[4] ..... B65B 63/04

[52] U.S. Cl. ..... 53/118; 242/67.3 R

[58] Field of Search ..... 53/118, 119, 430; 242/59, 67.3 R

[56] References Cited

U.S. PATENT DOCUMENTS 1,838,065 12/1931 Last .

4,025,420 5/1977 Horino ..... 53/430 X 4,063,693 12/1977 Achelpohl et al. ..... 53/118 X 4,196,846 4/1980 Kao et al. ..... 235/475

4,434,948 3/1984 Feldkamper ..... 53/118 X 4,438,618 3/1984 Honegger ..... 53/118 X

FOREIGN PATENT DOCUMENTS 2446280 9/1974 Fed. Rep. of Germany .

*Primary Examiner*—James F. Coan

*Attorney, Agent, or Firm*—Bacon & Thomas

[57] ABSTRACT

An apparatus for storing sheets in which the sheets are inserted between the various layers of a storage band wound onto a storage roller. The storage band, which is wound off a supply roller, is directed between the two rollers in such a way that it forms a horizontal deposit table which is freely accessible on several sides, on which the sheets may be deposited before being drawn onto the storage roller by a corresponding forward run of the band.

8 Claims, 5 Drawing Figures

APPARATUS FOR STORING SHEETS

The invention relates to an apparatus for storing sheets, comprising a supply roller, a storage roller and a storage band, the storage band being wound along with the sheets onto the storage roller so that the sheets are enclosed between the various layers of the resulting winding.

U.S. Pat. No. 1,838,065 discloses such an apparatus for storing checks and, if required, the data carriers assigned to them. The storage band is wound onto a storage roller from a supply roller, being directed over a deflection roller, among other things, which lies directly against the storage roller. The objects for storage are fed between the deflection roller and the storage roller, and are then enclosed between the various layers of the wound-up storage band by a corresponding rotation of the storage roller. The checks are fed in sequentially. If two objects—a check and a data carrier—are to be fed in simultaneously, a band is used which is wide enough to receive the objects in a parallel arrangement.

A further publication (German Auslegeschrift 24 46 280) discloses the storage of banderoles for bank-note packets in an apparatus of the above-mentioned type. In this arrangement, two storage bands are used, which are wound off separate supply rollers and superimposed over adjacent deflection rollers. The banderoles, which are supplied by a separate transport system, are threaded between these deflection rollers, thus coming between the two bands. The bands and the objects enclosed in them are then wound onto a common storage roller.

In both apparatus, the objects must be threaded between two rollers which lie very close to each other. It is thus practically impossible to feed in a number of objects simultaneously. At the same time, one must make sure that they are fed in accurately since sheets are only accepted when the storage band is running. If the objects are not grasped evenly along their entire width by the rollers, for example, tangential stress arises which may cause creases in the objects, or even damage them.

Since the moment of grasping and the position of the objects on the storage band are predetermined and it is only possible to feed them in when the storage band is running, the synchronization of the forward run of the band with the supplying transport system is unavoidable, in order that the objects be deposited selectively on the storage band.

In all known apparatus the sheets can only be fed to the storage band from one direction. It is thus possible to supply sheets via other transport systems only from this one given direction. In this connection it is known to arrange two transport systems one beside the other and supply sheets in a parallel arrangement to a storage band which is twice as wide. Apart from the resulting increase in the volume of the construction, it is particularly disadvantageous that in this case the movement of three different systems—the storage device and two transport systems—must be synchronized.

The invention is thus based on the problem of providing an apparatus for storing different kinds of sheets, the storage process being reliable and free of problems regardless of the number and quality of the sheets, and the sheets being conveyed to it by several transport systems, if required.

The basic principle of the invention is that the storage band is guided in such a way that a table-like surface is formed along a fairly long path, being freely accessible on several sides and allowing for sheets to be accepted directly onto the storage band from different directions. This provides the possibility of supplying objects via different transport systems and in the same area of the storage band. The variety of supply possibilities in the inventive apparatus involves the advantage that the objects for storage which are assigned to each other may be deposited in one and the same place. The joint storage of such objects in direct contact with each other assures reliable correlation of the various objects, which may be important when they are subsequently removed from storage. The multiple deposit of sheets in the same place, as is now possible, also allows for optimal utilization of the available storage space.

Since the inventive apparatus, contrary to known apparatus, offers the possibility of depositing the objects on the band when it is standing still, it is possible to deposit sheets on a predetermined area of the band unproblematically and accurately.

The predetermined areas of the band may be limited by markings which are simultaneously used as well to control the forward run of the band. The receiving areas can be very confined due to the possibility of selectively depositing the sheets in the marked areas and the precisely controlled forward run of the band. This allows for full utilization of the storage space available on the band.

A further advantage of the inventive apparatus is that the sheets are already located on the band when it is subsequently drawn onto the storage roller, so that the complicated threading processes known from prior art are unnecessary.

The new apparatus may be used advantageously for bank-note sorting machines, which process banderoled packets of bank-notes. In these apparatus the banderole, which bears, among other things, data on the origin of the bank-notes, is removed automatically from the bank-note bundle and fed to a separate transport system. The bank-notes are then singled, tested and directed to different places of deposit, depending on the test results. During sorting, such bank-notes are eliminated which, for example, are forged, of other denominations or not automatically testable. It is important in the case of bank-notes of these categories that their origin can be reliably determined when they are subsequently tested by hand. The necessary information is recorded on the banderole of the packet to which the particular bank-note belongs, so that it is very advantageous when the bank-notes can be intermediately stored in a simple manner together with the banderole until they are reworked by hand.

The inventive apparatus offers the possibility of intermediately storing bank-notes and banderoles in the desired form in a reliable and technically simple manner. The following description shows and explains, with reference to the figures, the inventive apparatus in its specific application within a bank-note sorter, whereby further advantages and advantageous developments shall become apparent.

The various figures show:

Figure 1:
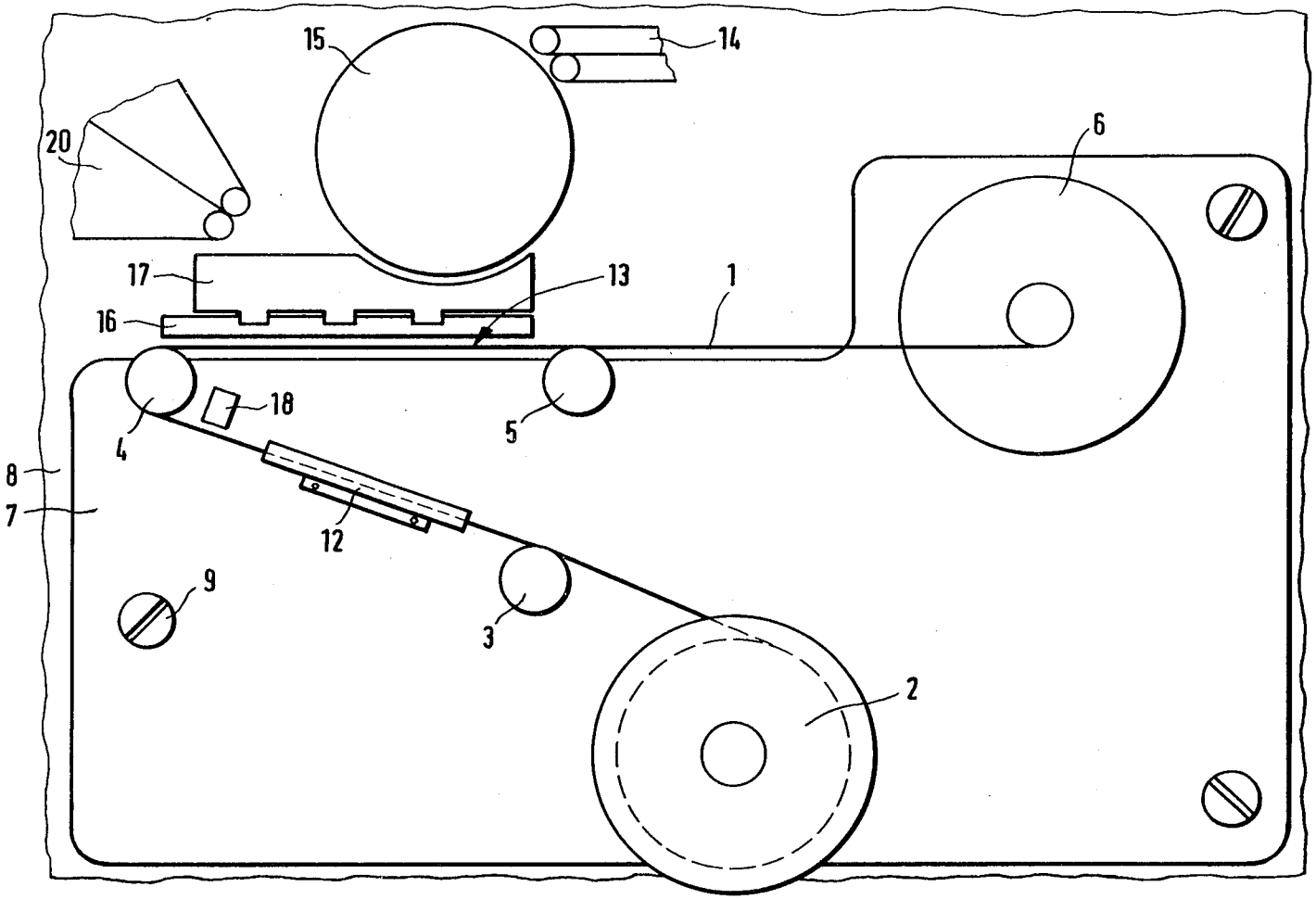
FIG. 1 is a front elevation view.
Figure 2:
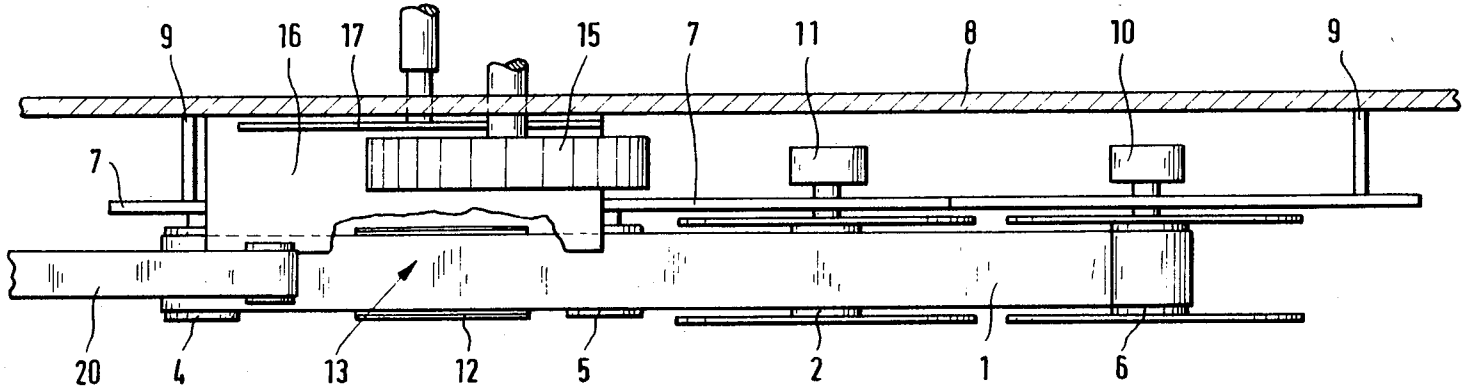
FIG. 2 is a top view.
Figure 3:
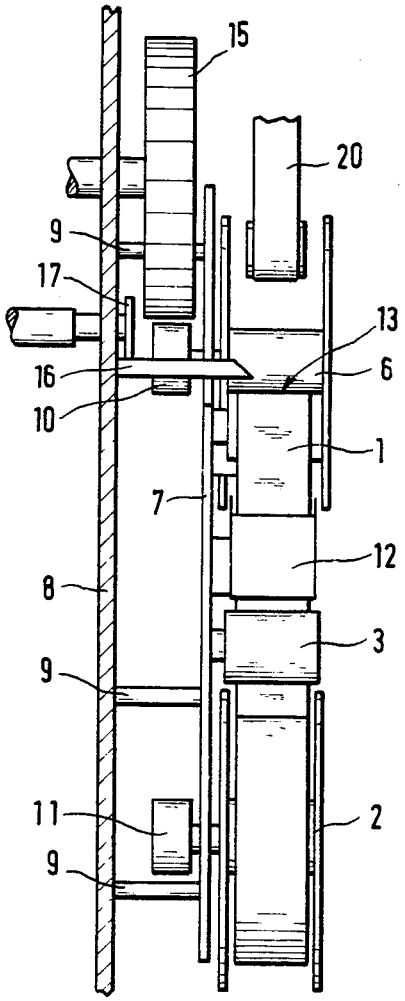
FIG. 3 is a side view.

FIGS. 1 to 3 show an exemplary embodiment of the new apparatus for storing sheets. It essentially comprises a supply roller 2, a storage roller 6, a storage band 1 and a few deflection rollers. Storage band 1, coming from supply roller 2, runs over several deflection rollers 3, 4, 5 onto storage roller 6, on which it is rewound. The supply roller, storage roller and guide rollers for the storage band are mounted, along with further elements of the apparatus, on a common mounting plate 7 which is attached by distance pins 9 to a mounting plate 8 belonging to the overall system of a bank-note sorter. To wind on the storage band, storage roller 6 is rotated in a counterclockwise direction by a motor 10. Braking means 11 at supply roller 2, e.g. a wrap-around brake band or a disk brake, holds the storage band under a constant tensile load. The storage band is guided by a guide plate 12 arranged between rollers 3 and 4. The storage band always has the same angle of inclination between rollers 3 and 4, so that it always engages with guide plate 12. The plate holds the storage band on a predetermined track, thus guaranteeing that the band is wound on accurately. The tensile load, which is constant over the entire width of the band, and the guaranteed track of the band assure that objects are enclosed reliably and firmly between the various layers of the band winding.

The band runs horizontally in the area between rollers 4 and 5, thus forming a deposit table for the objects to be stored. It is an essential feature of the apparatus that, due to the free accessibility of the band between rollers 4 and 5, objects of different types and coming from different directions can be deposited on a predetermined area of the band equally well. The various sections of the band are distinguished by markings on the band, as explained below in more detail with reference to FIG. 5, and may be detected by means of a photocell 18. Thus the forward run of the band is controlled in such a way that exact alignment of the various band sections between rollers 4 and 5 is given in each case to form the deposit table.

In the embodiment described here, the storage band is stopped while the sheets are deposited. Thus the objects are deposited in the intended section of the band accurately. Several objects may be deposited in the same place, regardless of whether they come from one transport system or from several. In the application of the storage apparatus in a bank-note sorter, as shown in the figures, those bank-notes in a packet which show discrepancies are, as mentioned above, to be brought together physically with the banderole originally connected with the packet. Such bank-notes (see FIGS. 1 and 2), coming from a belt transport system 14, are first collected on a stacker table 16 by a spiral pocket stacker 15 and then are laterally pushed away from the stacker table 16 to the storage band by a pusher 17 (FIG. 2)—which may be driven pneumatically, for example—to the predetermined deposit area on storage band 1. After the bank-notes are deposited, the banderole assigned to them is transported to them by a flat belt transport system 20, in which it has been intermediately stored, and is deposited on the bank-notes. The manner of supplying objects is by no means limited to the possibilities stated in this example. Different, or additional, transport systems may open into the receiving area of the storage band. In one variant, for example, objects may be directly deposited onto the storage band from the spiral pocket stacker 14. After an appropriate forward run of the band, the bank-notes are drawn together with the banderole into the storage roller and come to lie between the various layers of the wound-up storage band. At the same time the deposit table is cleared again for the next deposit of sheets. The axle diameter of storage roller 6 and the band width are dimensioned in such a way that several objects may be reliably drawn into the storage roller at the same time.

The localized deposit of the sheets on the stationary band is advantageous in that the storage space available on a band can be optimally utilized. The precisely controllable intermittent forward run of the storage band allows for the intervals between the various groups of objects on the storage band to be set very small, thereby avoiding unnecessary "idle pull-in". This means that the band is only run forward when objects have been deposited. This point is of special importance in the case of bank-note sorters since the bank-notes showing irregularities usually crop up in an irregular sequence. In the case of a continuous forward run of the band it is thus drawn in empty at times when no bank-notes are being conveyed to it, thereby wasting storage space. Furthermore, it is unnecessary in this example of the inventive apparatus to provide coordination of several transport systems in movement at the same time, which may be very troublesome technically in some cases.

When more and more storage band is wound onto the storage roller, its diameter increases, leading to a corresponding inclination of the storage band between roller 5 and the storage roller. The distance between roller 5 and the storage roller and the periphery of the storage roller when it is full are selected in such a way that the transport of the sheets on the band is not disturbed by the maximum inclination of the band. When, for reasons of space, the distance between storage roller 6 and deflection roller 5 can only be very small, vertical compensation for the storage roller must be provided. The axle of the storage roller is then mounted, for example, so as to be vertically adjustable depending on the periphery of the storage roller.

Figure 4:
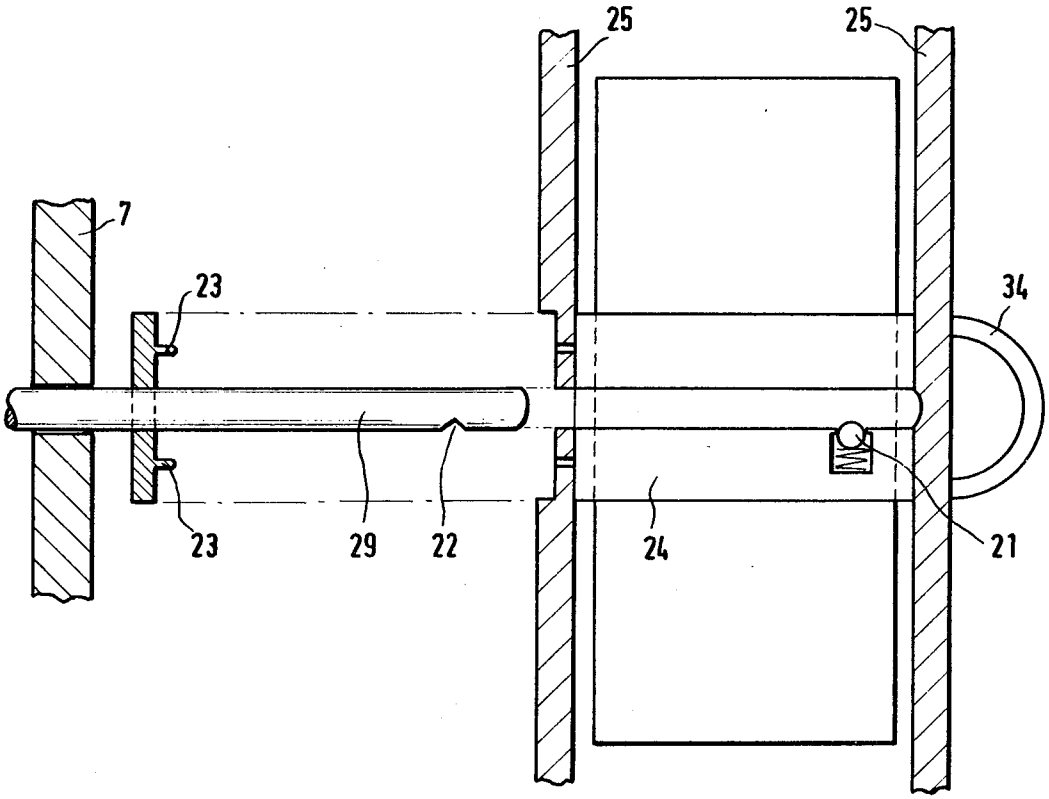
FIG. 4 is a side elevation view of a storage roller.

FIG. 4 shows an exemplary embodiment of a storage roller having a construction identical to that of the supply roller, and the accompanying holding means 19. The storage roller essentially comprises a cylinder 24 enclosed between two walls 25, the cylinder 24 being pushed onto axle 29 of the holding means. The storage roller equipped with a handle 34 is stopped by a ball shock-mounted in the cylinder, which engages with a correspondingly designed notch 22 in axle 29. Suitable follower pins 23 serve to transfer the rotational movement of the storage roller.

Within cylinder 24 a mechanical clamping means has been provided for fixing the beginning of the storage band. A full storage roller may be fixed in place, for example, by springs mounted in the wall of the storage roller. Another possibility of preventing the band from coming unrolled during subsequent transport is to provide the end of the storage band with Velcro, self-adhesive or magnetically adhesive surfaces.

Figure 5:
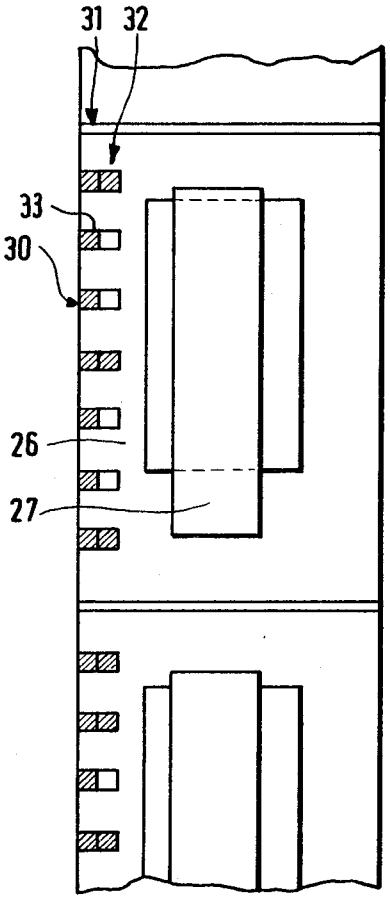
FIG. 5 is a top view of the storage band.

FIG. 5 shows a section of the storage band with the sheets superimposed, bank-note 26 and banderole 27. The material of the band is preferably polyethylene, since it is extremely resistant to tearing but can still be elastically stretched to a certain degree. These properties allow for the sheets to be wound between the layers of the band without any problem. The objects are deposited in an area defined by transverse stripes 31. These transverse stripes are repeated at regular intervals along the entire length of the storage band. They limit the various depositing sections. In order to assure accurate deposit within the sections, the forward run of the band is controlled via these transverse stripes. If the band is made of translucent material, the transverse stripes may be printed black markings, for example, which are detected by means of a photodetector 18 or light barriers working in incident or transmitted light. The corresponding signals are passed along by this photodetector to the driving motor of the storage roller.

The forward run of the band could also be controlled by mechanical scanning if the band is provided, for example, with perforations which are picked up mechanically.

Within a section on the storage band there is a marking 30 indicating the particular band number and the section number along with further data. In the exemplary embodiment shown here, the marking is a self-timing digital code which can be read optically. Track 32 is the clock track and consists of black bars printed on the band at regular intervals, whereas track 33 is the code. The code, which is printed directly on the band in this embodiment, is read by appropriate detectors while the band runs forward. If bank-notes are deposited along with the accompanying banderole in a section of the band, the section number and the band number are recorded and registered along with further data relating to the sorting process, to be used for later reworking, among other things.

In one variant, both the clock track and the information track are provided consistently with black bars and the code is applied subsequently by punching out the information track. This possibility is advantageous in that the bands, which are originally neutral, are only coded in case of use and can thus be provided with specific codings relating to the purpose at hand. The coding can then be carried out, for example, by a punching device applied during the transport of the band (not shown in the figures) and may contain current information relating, for example, to the current sorting process, the labor time, the operating staff or the number of, and reason for, the bank-notes eliminated from that particular section of the band. This current coding takes place during the forward run of the band and can be applied to the band by quite different means to those described here. Printing or stamping methods, for example, may also be used.

In an advantageous embodiment, means are provided on the storage band so that the ends of one storage band can be connected with the beginning of another storage band. This connection may also be realized, for example, by Velcro. This substantially facilitates the threading process for a new storage band. When the storage volume of a storage band is used up, the forward run of the band is stopped before the entire storage band is wound onto the storage roller and the end of the band is still located in the area of the supply roller. The empty supply roller is then removed and replaced by a new one. The beginning of the new storage band is then fastened to the end of the storage band still located in the apparatus. When the old storage band is finally pulled onto the storage roller the new storage band is thus automatically wound into the apparatus.

A special working table is provided for the subsequent manual reworking of the objects stored in this manner. The guiding means for the storage band and the arrangement of the rollers—the storage roller and the empty roller onto which the storage band is rewound—have approximately the same basic features as shown in FIGS. 1 to 3. When the storage band is unwound, the objects enclosed in it are released. The forward run of the band is controlled, as already mentioned, by the markings of the various sections of the band. A photodetector is also provided to read the coding on the band and indicate the current section number in clear text to the operator. The band is run in such a way that both forward and backward movement are possible under the necessary tensile load. Thus processing may be interrupted and the band rewound onto the storage roller. In order to speed up the winding of the band in case of an interruption, several speeds are available for forward and backward run.

When the coding on the band only contained neutral band-specific data, the various storage bands may be reused any time. If current data were recorded on the storage band, it is usually not reusable unless the coding can be removed. In order to reduce the resulting material costs, inexpensive materials are used in such a case for the storage band. It is possible, for example, to use paper resistant to tearing.

We claim:

1. An apparatus for storing sheets comprising a supply roller; a storage roller; a storage band; the storage band being unwound from the supply roller and wound onto the storage roller along a path disposed between the rollers for enclosing the sheets between layers of the resulting winding, wherein the storage band defines a horizontally extending deposit table means along the path for receiving the sheets and being of sufficient length to accommodate sheets deposited thereon; at least two transport systems terminating at said deposit table means for transporting at least two distinct sheets to said deposit table means for deposit on said storage band; interruption means for interrupting the winding movement of the storage band while two distinct sheets are being deposited on the storage band from said two transport systems and continuing the winding after the distinct sheets have been deposited on the winding band.

2. An apparatus as claimed in claim 1, including means for depositing said two distinct sheets in superimposed relationship on said storage band from said transport systems while the winding movement of said storage band is interrupted.

3. Apparatus as claimed in claim 2, wherein said two distinct sheets are of different size and different physical characteristics, e.g., a bank note and its associated banderole.

4. Apparatus as claimed in claim 1, wherein said storage band comprises a strip material bearing along one edge a coating indicia marked directly on the band material, and means for sensing said coating indicia.

5. Apparatus as claimed in claim 4, wherein said band is made of translucent synthetic material and said coating indicia comprises light-blocking markings.

6. Apparatus as claimed in claim 4, wherein said coating indicia comprises dual tracks of information extending along said one edge.

7. An apparatus for storing sheets comprising a supply roller; a storage roller; a storage band; the storage band being unwound from the supply roller and wound onto the storage roller along a path disposed between the rollers for enclosing the sheets between layers of the resulting winding, wherein the storage band defines a horizontally extending deposit table means along the path for receiving the sheets and being of sufficient length to accommodate sheets deposited thereon; at least two transport systems terminating at said deposit table means, one of said transport systems transporting a series of sheets to be deposited on said deposit table means in stacked relationship, the other transport system transporting a singular sheet to be deposited atop said stacked series of sheets; interruption means for interrupting the winding movement of the storage band while said series of sheets and singular sheet are being deposited on the storage band from said two transport systems and continuing the winding after the sheets have been deposited on the winding band.

8. Apparatus as claimed in claim 7, wherein said series of sheets are deposited on said deposit table means laterally of said deposit table means, and said singular sheet is deposited on said deposit table means from a direction parallel to said deposit table means.

* * * * *